US005082274A

United States Patent [19]

Bright

[11] Patent Number: 5,082,274

[45] Date of Patent: Jan. 21, 1992

[54] GAMES AND RANDOM SELECTION APPARATUS THEREFOR

[76] Inventor: Robert P. Bright, 50 Shepherds Close, Hurley, Maidenhead, Berkshire, United Kingdom

[21] Appl. No.: 623,750

[22] PCT Filed: Jun. 2, 1989

[86] PCT No.: PCT/GB89/00612

§ 371 Date: Dec. 10, 1990

§ 102(e) Date: Dec. 10, 1990

[87] PCT Pub. No.: WO89/12386

PCT Pub. Date: Dec. 28, 1989

[30] Foreign Application Priority Data

Jun. 14, 1988 [GB] United Kingdom ..... 8814105

[51] Int. Cl.[5] ..... A63F 9/00; A63B 71/00

[52] U.S. Cl. ..... 273/138 A; 273/139; 273/443; 273/448

[58] Field of Search ..... 273/138 A, 138 R, 139, 273/443, 447, 448, 456, 144 R, 144 A, 144 B

[56] References Cited

U.S. PATENT DOCUMENTS

| | | | |
|---|---|---|---|
| 2,361,580 | 10/1944 | Waring | 273/144 R |
| 2,657,059 | 10/1953 | Selig | 273/144 R |
| 3,698,711 | 10/1972 | Bullard | 273/447 |
| 3,734,502 | 5/1973 | Bolton | 273/456 X |
| 3,836,142 | 9/1974 | Baker | 273/448 |
| 4,326,709 | 4/1982 | Croyle | 273/448 |
| 4,432,544 | 2/1984 | Wakimura | 273/448 |
| 4,508,346 | 4/1985 | Salvucci | 273/144 B |

*Primary Examiner*—Edward M. Coven
*Assistant Examiner*—Sebastiano Passaniti
*Attorney, Agent, or Firm*—Price, Gess & Ubell

[57] ABSTRACT

A random selection apparatus for a game is provided. The apparatus includes a container having a chamber and a tapering throat. A magnetic object is housed within the chamber and is held captive therein by the tapering throat. The magnetic object includes at least one pair of magnetically polarized opposing faces. A magnetically polarized elongate member is provided which is sufficiently narrow for insertion into the chamber through the throat. Upon insertion, a polarized end of the elongate member magnetically interacts with the magnetic object in the chamber and, upon removal from the chamber, draws the magnetic object to the throat of the container, where the object is temporarily lodged, with one of the two opposing faces exposed for view. In this manner, one of the opposing faces of the amgnetic object is randomly presented for view at the throat of the container. Games are provided in which the apparatus is used.

13 Claims, 4 Drawing Sheets

GAMES AND RANDOM SELECTION APPARATUS THEREFOR

BACKGROUND OF THE INVENTION

1. Field of the Invention

The present invention relates to games and random selection apparatus therefor.

2. Description of the Prior Art

Games are known which use dice which can be thrown to generate a random number between one and six. The number thrown then determines the next move in the game.

Games are also known where a coin is tossed to determine the next move in the game.

The roulette wheel on a roulette table allows any number between 0 to 36 to be generated at random.

All these devices are forms of random selection apparatus. The present invention relates to novel form of random selection apparatus.

SUMMARY OF THE INVENTION

According to the present invention there is provided random selection apparatus comprising a container defining a chamber having a tapering throat, a magnetic member housed in the chamber having at least one pair of opposite differently designed faces magnetically polarised as North and South poles respectively, the taper of the throat being such as to hold the member captive within the container, an elongate member magnetically polarised by North and South poles at opposite ends and having a cross-section sufficiently small to enter the chamber through the throat, the floor of the chamber being so profiled that when the member lies on the floor, the upper face will never extend parallel to the mouth of the throat whereby when a randomly selected end of the elongate member is inserted into the chamber and then withdrawn it will coact with the magnetic member and draw the magnetic member into the throat for lodgement therein so that a randomly selected face of the magnetic member becomes exposed to view.

According to the present invention there is further provided a random selection apparatus comprising a container defining a chamber having an open mouth, a magnetic member held captive in said chamber, said magnetic member having different surfaces carrying different legends and being magetically polarised along a first predetermined axis to present North and South poles respectively, and an elongate member having at least a portion magnetically polarised along a second predetermined axis, the second predetermined axis when said elongate member is inserted into said mouth being inclined to the first predetermined axis when said magnetic member lies on the floor of said chamber whereby to ensure that the magnetic member is attracted to the elongate member, and means for maintaining said magnetic member in the region of said mouth when drawn thereto by said elongate member.

According to the present invention there is still further provided a snooker game comprising means defining a surface of magnetisable material and forming a playing surface, a plurality of coloured magnets equal in number and colour to the balls used in a game of snooker, a cue having opposite ends oppositely magnetised to attract or repel a magnet when a selected end of the cue is moved towards a selected magnet, pocket means responsive to the polarity of the end of the cue carrying an attracted magnet to randomly indicate success or failure of the shot, and a set of rules specifying that play takes place generally in accordance with the game of snooker and that (a) the player applies the cue to a selected magnet and, if the magnet is repelled, the play passes to the next player, (b) if the selected magnet is attracted, the cue and magnet are applied to the pocket means which will respond to indicate the success or failure of the shot, (c) upon failure of the shot play passes to the next player, (d) success of a shot indicating that as in the game of snooker the ball is pocketed and entitling the player to apply his cue to the next magnet selected in accordance with the rules of snooker where upon the proceedure from (a) to (d) is repeated, and (e) scoring being conducted generally in accordance with the game of snooker.

BRIEF DESCRIPTION OF THE DRAWINGS

Random selection apparatus and a game embodying the present invention will now be described by way of example with reference to the accompanying diagrammatic drawings in which.

DETAILED DESCRIPTION OF THE PREFERRED EMBODIMENTS

Figure 1:
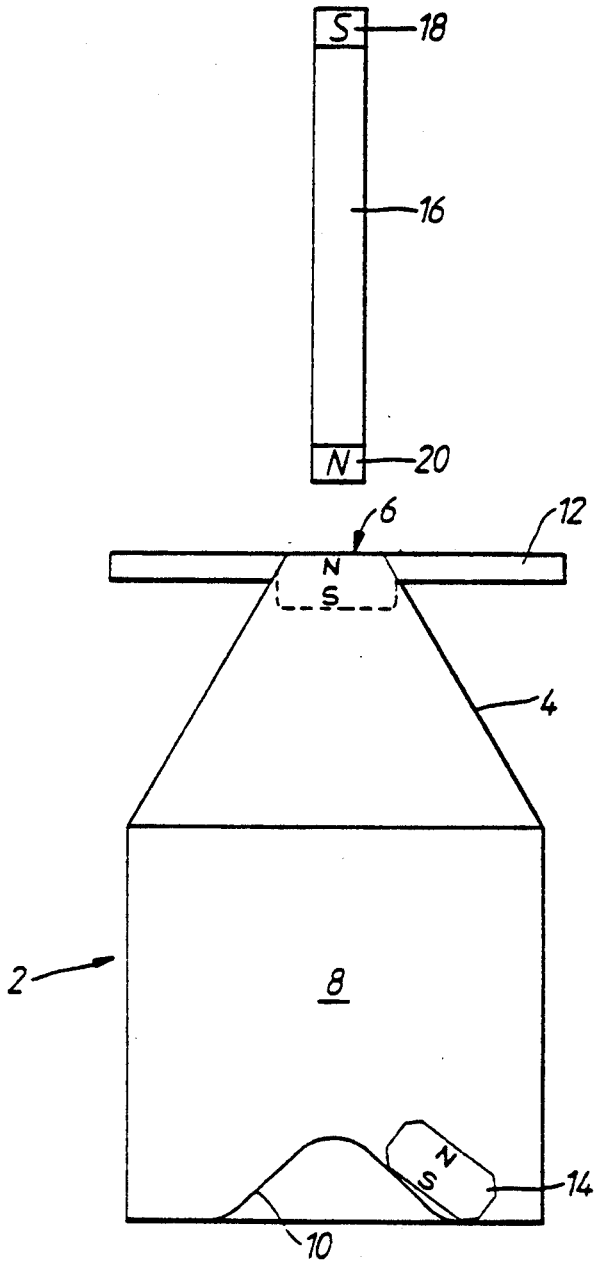
FIG. 1 is a cross-section through one embodiment of random selection apparatus.

The random selection apparatus shown in FIG. 1 comprises a container 2 having a tapered neck 4 terminating in an open mouth 6 and defining a chamber 8.

The floor of the chamber has a central hump 10 which lies vertically below the mouth.

The mouth of the chamber is encircled by an annular member 12 of magnetisable material (e.g. soft iron).

Located inside the chamber is a magnetic member 14 having parallel end faces and being of circular cross-section. In a modification the member may have more than one pair of parallel end faces to define two or more pole pairs.

The member 14 is magnetised, to form a permanent magnet, having, for example 2,200 gauss, so that opposite end faces present North and South poles respectively.

In addition each end face is visually different. For example, the end faces may be of different colour or bear different legends, for example, the legends "YES" and "NO".

The magnetic member 14 has its sides chamfered or tapered adjacent each face. The angle of taper being equal to the angle of taper of the neck 4.

An elongate selector rod 16 has magnetic members 18 and 20 at opposite ends so arranged that the opposite end faces of the rod 16 present North and South poles respectively. Instead the whole rod 16 may be of magnetic material and magnetised to around 12,500 gauss to present North and South poles at opposite end faces.

The opposite end portions of the rod 16 are visually identical so that it is impossible to distinguish one end from the other merely by viewing.

In operation the magnetic member 1 is held captive in the container 2 and it will be assumed that it lies on the bottom of the container as shown in FIG. 1. The hump 10 ensures that neither planar face of the member 14 is parallel to the mouth 6 of the container.

To use the random selection apparatus the rod 16 is randomly rotated about its centre like a propeller, stopped, and then one end thereof is lowered into the container 32 until the magnetic member 14 "flips" or is attracted to the free end of the rod. The fact that the magnetic member 14 is prevented by the hump 10 from sitting flat on the floor of the container ensures that the magnetic reaction between the rod and the member is never one which is solely a repelling force (in which case the member would not be attracted to the rod) but that there is always a component of attractive force. This ensures that the member is attracted to the rod. Sometimes a stirring action of the rod may be necessary.

Once the member 14 has been attracted to the rod 16, the rod is drawn upwardly to bring the member 14 into the tapering neck at which point the member becomes centralised in the mouth 16 and prevented from moving further upwardly. As the rod 16 continues to move up it becomes separated from the member 14. The magnetic lines of force emanating from the member 14 then coact with the magnetisable annular member 12 and this holds the member 14 in the mouth of the container. With the rod removed the legend on the exposed face of the member 14 becomes visible e.g. "YES" or "NO" and if a game is being played appropriate action can be taken.

Before the next "move" in the game the annular member 12 is tapped sharply to dislodge the magnetic member 14 from the mouth 6 and to cause it to fall to the floor of the chamber 2. The rod 16 is randomly turned and the selection process is then repeated. Instead the member 14 may be dislodged by "poking" with a non magnetic member. In yet another version the rod 16 may be merely applied to the mouth 6 and caused to enter the container 2. If like poles face one another, the magnetic member 14 will be repelled and fall to the floor where, upon further lowering of the rod, the member will become reorientated and be again attracted to the rod 16. If unlike poles face one another the member 14 will be magnetically attracted to the rod 16 and remain with the rod as it dips into the container and will only be released from the rod 16 when the rod is withdrawn from the container 2.

Preferably the exposed face of the member when held captive in the neck is flush with the mouth. The annular magnetisable member 12 may be in the form of a layer of magnetisable ink deposited on a substrate.

In a modification instead of the annular magnetisable member 12 being provided to hold the member 14 captive in the neck, the neck of the container may be lined with a compressable material so that as the member is drawn up into the neck it becomes temporarily wedged therein.

In yet another modification the neck of the container may be of flexible material which has the same wedging effect on the member.

The container which is advantageously of plastics material may have a profile other than that shown in the drawings. For example both the body of the container and the neck can have the cross-section of a regular polygon for example having eight sides or more. The container may be provided with a door or lid to enable the magnetic member 14 to be replaced with another member differently magentised or bearing different legends.

Figure 2:
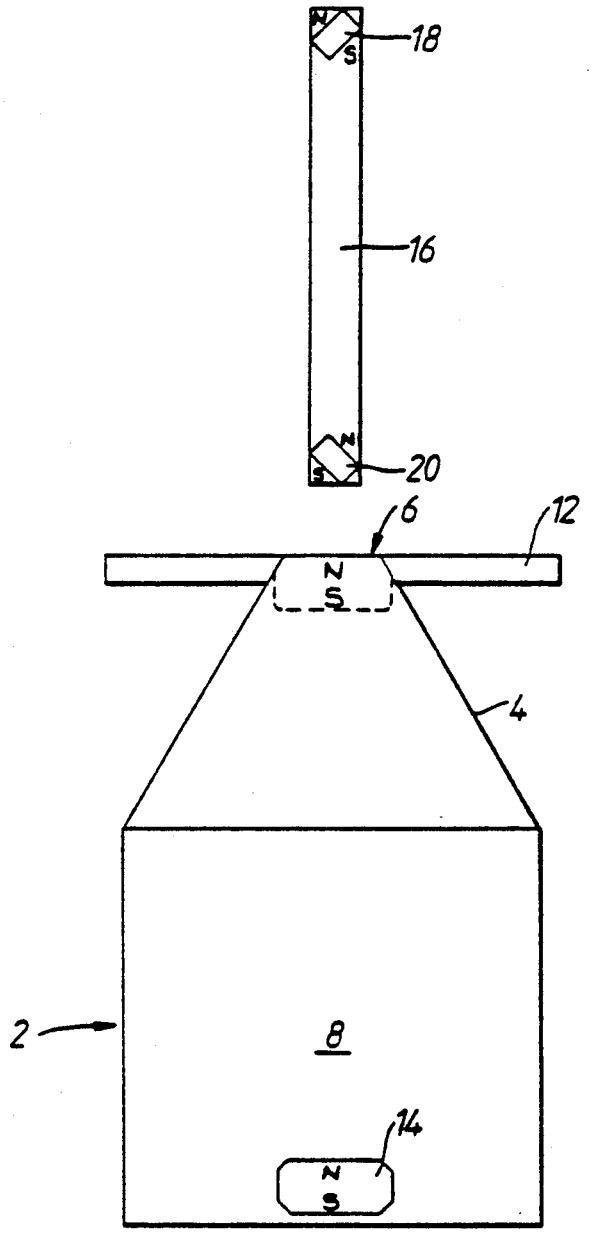
FIG. 2 is a cross-section through another form of random selection apparatus.

In the random selection apparatus shown in FIG. 2 parts similar to those in FIG. 1 are similarly referenced. In particular the hump in the floor of the chamber 8 is omitted and instead the opposite ends of the rod 16 are provided with respective ones of two permanent magnet discs each having their magnetic axes inclined to the axis of the rod 16. In this manner when the rod 16 is inserted into the chamber 8 with the magnetic member 12 lying on the flat floor of the chamber 8, the magnetic axis of the adjacent pole of the rod will be inclined to the magnetic axis of the disc thereby ensuring that there will always be a component of attractive force between the rod 16 and the member 14 to enable its attraction to the rod 16 when the rod is withdrawn from the chamber.

Figure 3:
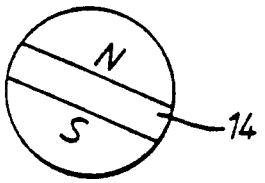
FIG. 3 is a modified form of the magnetic member used in the apparatus of FIG. 1 or FIG. 2.

In one modification the magnetic member 14 may comprise a disc magnet encapsulated in resin or plastics material to form a sphere (see FIG. 3). The surface area of the sphere may be appropriately annotated with legends.

Figure 4:
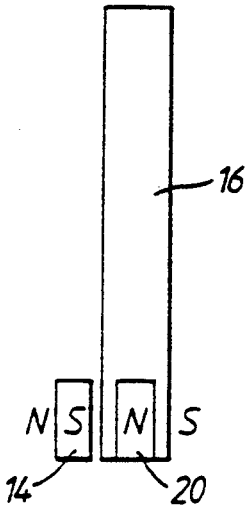
FIGS. 4 and 5 are a modified form of the selection rod used in the apparatus of FIG. 1 or FIG. 2, showing two possible positions of coaction with a magnetic member.
Figure 5:
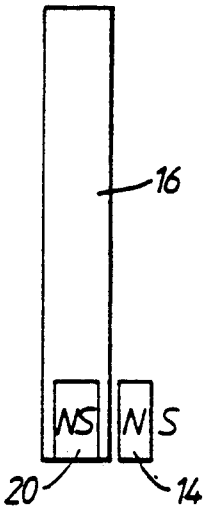

The rod 16 of FIG. 2 may take a modified form in which a single disc magnet 20 is included in one end only but with its magnetic axis extending at right angles to the longitudinal axis of the rod 16. In this way when the rod 16 is lowered into the chamber 8 the magnetic member 14 will be attracted to one of the two opposite side faces of the end portion of the rod 16. FIGS. 4 and 5 show two alternative positions of the magnetic member 14 relative to the rod 16. The side face to which the member 14 is attracted will depend upon the orientation of the rod about its longitudinal axis as it is lowered into the chamber 14 and upon the exact location of the member 14 on the floor of the chamber. When it is first attracted to the rod 16 (see FIGS. 4 and 5) the axis of the magnetic member 14 will extend horizontally but as the rod 16 is withdrawn from the chamber the member 14 will coact with the throat in the chamber and will turn into the vertical.

This particular arrangement makes it more difficult for players to cheat by marking the rod in a manner to be able to discern the polarities of the two ends of the rod and therefore enabling the determination of which face of the member 14 will be attracted to the mouth 6.

Figure 6:
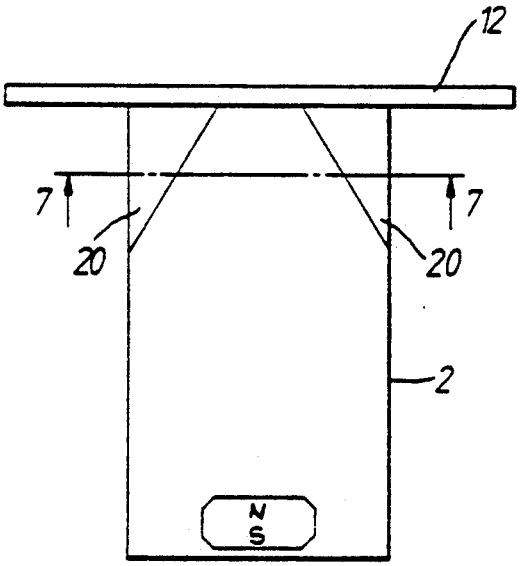
FIG. 6 is a modified form of the container for the apparatus of FIG. 1 or FIG. 2.
Figure 7:
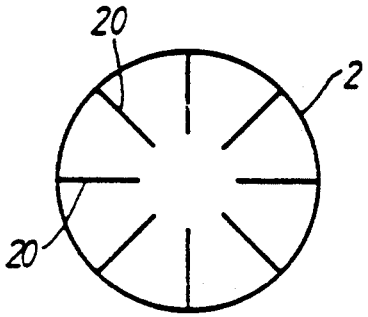
FIG. 7 is a cross-section on the line 7—7 of FIG. 6.

In yet another modification the container 2 may be of cylindrical configuration. See FIG. 6. In this case the throat is formed by an array equiangularly spaced ribs 20 mounted at the upper end of the cylindrical container. As shown in FIGS. 6 and 7 each rib 20 is of triangular configuration, is supported on the inner face of the cylindrical container and extends radially inwardly. It will of course, be appreciated that other forms of construction may be used to form an interrupted throat for coaction with the magnetic member 14.

The random selection apparatus can be used to select the next move in a variety of board and other games.

One particular game in which the random selection apparatus finds application is a novel game of magnetic snooker which will now be described with reference to FIG. 2. The apparatus will be hereinafter referred to as a "flipper device" which is descriptive of the action of the member 14 in the container 2.

Figure 8:
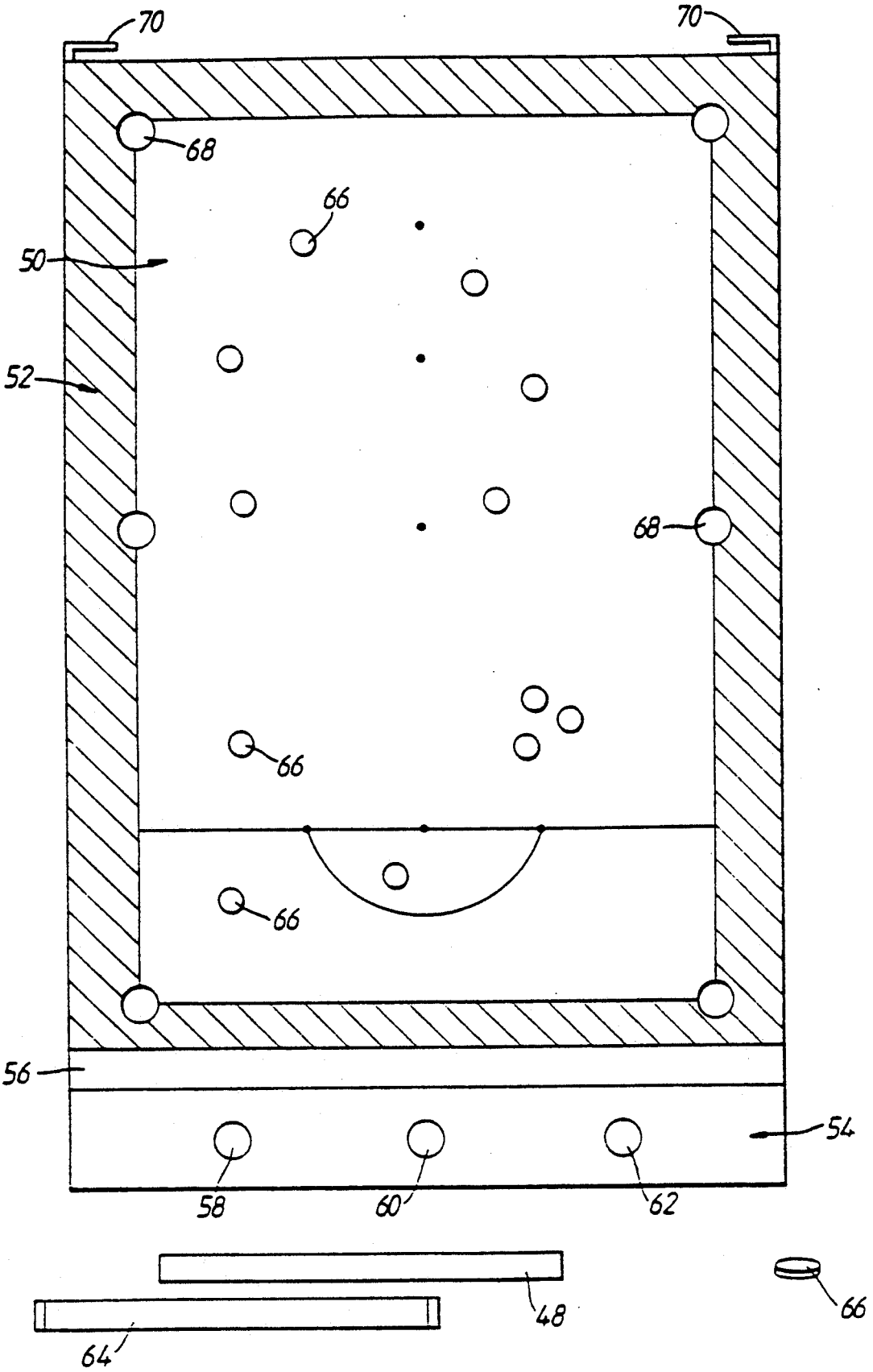
FIG. 8 is a plan view of the game incorporating nine random selection apparatus each as shown in FIG. 1.

As shown in FIG. 8 the game includes a magnetisable plate 50 advantageously coloured green. A rectangular frame 52 advantageously coloured brown is mounted on the plate 50 (for example by adhesive) to define a playing area and has three sides whose outer extremities are aligned with the outer extremities of corresponding ones of three sides of the plate 50. The fourth side of the frame 52 is spaced inwardly from the fourth side of the plate so that a portion of the plate 50 projects beyond the frame 52 to form a shelf 54. The shelf 54 carries a tray 56 for accommodating a rod 64 (hereinafter referred to as a cue) magnetised North and South poles at opposite ends, a row of magnetised discs 66 (hereinafter referred to as balls), and a wooden rod 48 of similar dimensions to the rod 64.

The shelf 54 also has three circular apertures 58, 60 and 62 respectively marked "SNOOKER" "ESCAPE" and "SAFE".

Below each aperture lies a flipper device. In the flipper devices the annular magnetisable member 12 (see FIG. 1) may be replaced by the plate 50 itself.

The disc 14 in the flipper device below the aperture 58 has opposite sides coloured yellow and green and designated "YES" and "NO" respectively.

The disc 14 in the flipper device below the aperture 60 has opposite sides coloured brown and blue and designated "FOUL" and "YES" respectively.

The disc 14 in the flipper device below the aperture 62 has opposite sides coloured pink and black and designated "YES" and "NO" respectively.

The side of the frame remote from the shelf 54 carries a pair of brackets 70 for supporting a score board (not shown). The score board can take the form of a conventional sliding marker and scale.

The plate is also provided with apertures 68 at the inner four corners of the frame 50 and midway along the two longest sides of the frame 50, positioned in the manner of pockets on a snooker table. Below each aperture 68 lies a respective flipper device as in FIG. 1. Again as with the flipper devices below the apertures 58 to 62, the plate 50 replaces the annular magnetisable member 12 of FIG. 1. The disc 14 in each of these flipper devices is coloured yellow and marked "POT" on one side and is coloured green and marked "MISS" on the opposite side.

The rod 48 may be used to dislodge the disc in each flipper device from the mouth.

The playing area is marked out as a conventional snooker table.

A series of disk magnets 66 (balls) each oppositely magnetised on opposite faces are provided equal in number and having the same colours as the balls in the conventional game of snooker.

The "balls" 66 are substantially the same diameter as the end of the cue (but are advantageously smaller) and so with the cue can enter the apertures leading to each flipper device.

The game is played in a manner closely following the game of snooker and the winner as in snooker is the player with the highest score.

Play takes place by using the cue to magnetically attract the white or cue ball and once attracted the cue and cue ball are used in an attempt to attract a red ball. If the red ball is attracted, the cue, the cue ball and the red ball are inserted into a flipper device below any selected aperture or "pocket" 68 and upon withdrawal the disc 14 in the flipper device will indicate whether or not the red ball is deemed to be pocketed.

If the red ball is deemed to be pocketed it is removed from the cue and placed in the tray 56.

The player then attempts to attract a selected "coloured" (i.e. non red) ball to the cue. If successfully, the cue ball and the selected coloured ball are inserted into a flipper device below any selected aperture 68 to determine whether or not the coloured ball is deemed to be pocketed.

The selection of further balls continues as in accordance with the rules of snooker until either a selected ball fails to be attracted to the cue and the cue ball, the flipper device indicates a miss or the player makes a foul shot or otherwise infringes the rules. This then ends the "break" for the current player and the play then passes on to his opponent. Play continues until all the balls have been cleared from the table or until one player concedes defeat.

The game also deals with fouls shots, snookers and other events which occur in the conventional snooker game and this will be described hereinafter in conjunction with a more detailed set of rules which follow.

1. The game is to be played generally in accordance with the game of Snooker.

2. Preparing the table for play (a) Place the scoreboard (not shown) into the slots 70 put score markers onto zero and decide the number of frames to be played in the match (1, 3, 5, 7, 9 etc).

(b) Clear the disc from the mouth of the flipper device marked "Escape" using the small wooden rod provided.

(c) Using the cue 64, ensure that the coloured discs are lodged in the mouth of the flipper devices at the apertures marked "Snooker" and "Safe"

(d) Place the coloured balls (yellow, green, brown, blue, pink and black) on their correct spots making sure some are placed North Pole up and some South Pole up. Place the white in the "D".

(e) Toss a coin. The winner of the toss may choose to break or may request his opponent to break. Whoever breaks then places the reds on the table in a random manner.

NOTE: It is strongly recommended to place both reds and colours on the table so that about half their North Poles uppermost and the remainder have their South Poles uppermost. This makes the game more interesting and much more enjoyable to play.

3. Starting the game.

(a) Playing the white ball.

The breaking player must cue up the white ball as described below.

He must hold the cue directly above the white and slowly lower it down. The white will either be attracted or repelled. If it is repelled the player should secretly rotate the cue about a line extending at right angles to the axis of the cue (preferably the line passes through the centre of the cue) and pass it to his opponent who then may take his turn. If it is repelled and strikes another ball the opponent is awarded the penalty value of the ball struck and the play passes to the opponent as before. If it attracts the white ball the player must then attempt to play a red.

(b) Important: The process described above is only carried out at the start of each players turn. Once he has begun a break by picking up the white he may move it by hand from one end of the cue to the other without incurring any penalty.

4. Picking up and potting a red.

(a) Picking up a red ball.

The end of the cue carrying the white ball is lowered onto a red until it either attracts or repells. If it repells no foul has been committed, the white is removed from the end of the cue and returned to the table in a random position then passes to his opponent. If however the red is picked up the player may then go for the pot.

(b) The player must lower the red (still on the white and cue) into any one of the pockets 68 he chooses. This will activate the flipper device. On slowly withdrawing the cue from the pocket the coloured disc becomes lodged in the mouth. The disc is yellow on one side and green on the other. On the yellow side the word "Pot" is printed and on the green side the word "Miss". If a miss is registered both balls on the cue are returned randomly to the table and play passes on to the opponent. If a pot is register the red ball is returned to the tray. The players score is advanced by one point and he may then attempt to pot a colour.

5. Potting a colour and breakbuilding.

(a) The white may be moved to whichever end of the cue the player thinks will be advantageous. The player must then nominate out loud the colour he will attempt to pot.

The same selection and potting method is used as has been described in connection with the red ball and if the shot is a miss then the colour and play passes to the next player. If however, a pot occurs the players score is advanced by the correct number of points, the colour is removed from the cue and replaced to its own spot. It may be that the spot has become occupied by another ball. In this case the ball (the one just potted) should be put on the highest available spot. If all the spots are occupied it should be placed as near to its own spot as possible in a direct line to the top cushion.

(b) By taking another red and then another colour and continuing red, colour, red, colour, etc it is possible to build a big break. Play continues until the last red and colour have been potted, (the final colour always being returned to its spot). The player then begins to pot the last six colours. These are to be potted in the correct sequence which is yellow, green, brown, blue, pink and black. If the scores are level after the black is potted it is respotted and the white is placed in the "D". A coin is tossed and the winner of the toss may take first turn or invite his opponent to play. The cue should be rotated secretly and passed to the player who will take first shot. He must pick up the white as described before and then attempt the pot. It should be noted that as in real snooker the first player to play a foul while only the black is on the table is the loser. Equally, the winner is the player who successfully pots the black. So the choice of who plays first shot on the final, respotted black is not an easy one.

6. Safety, Snooker and Escape shots.

Up to now these rules have dealt only with potting and breakbuilding. In real snooker safety is a vital tactic, as is "snookering" an opponent.

(a) Safety shots.

Provided that the white and a red/coloured ball have been picked up a safety shot may be played at any stage in the frame. This is done by inserting the cue with the balls attached, into the hole marked "Safety". On withdrawal either the word "Yes" or "No" will register. If "No" appears the balls are returned to the table in a random position. No penalty is incurred and play passes on to your opponent. If "Yes" appears the balls are replaced on the table with the white in a very safe (but non-snookering) position.

This is the start of a safety dual. The opponent cannot score because you have achieved the perfect safety shot. After engaging the white and the object ball the opponent must attempt a safety shot of his own. If he registers a "No" he must replace the balls in a random position but if he registers "YES" he must return the balls to the table with the white again in a very safe position. The following player must then play another safety shot but on this occasion, if successful, he may attempt to improve it into a "snooker".

(b) Snooker shots.

With the white and object balls remaining on the cue, the cue is inserted into the aperture marked "Snooker". On withdrawal if "No" registers it is still a perfect safety shot, and the balls are returned to the table and play passes on. If "Yes" registers the object ball is returned to the table and the white ball is placed in a snookering position where there is no direct unobstructed line of view to any red ball. The opponent must then attempt an escape. To do this he must insert the cue and with ONLY the white ball attached into the hole marked "Escape". If "Foul" appears, points are awarded to the other player in the following manner.

The other player must insert the cue into the snooker and safe flippers so that two colours are presented at random. The penalty value is then assesed in accordance with the following table;

| | |
|---|---|
| Yellow and Pink | 4 pts. |
| Yellow and Black | 5 pts. |
| Green and Pink | 6 pts. |
| Green and Black | 7 pts. |

The player committing the foul may be asked by the other player either to play again or to deem his turn finished. (If the opponent is made to play again after any foul has been committed the cue may be secretly rotated by the other player before play is resumed). If "Yes" appears the opponent may place the object ball by hand onto the white and attempt to improve his escape into a pot, a safety shot or another snooker.

(c) Snooker shots are playable at any time except. (1) If asked to play again after committing a foul shot. (2) When responding to an opponents first safety shot. (3) When only the black ball remains on the table.

7. General Rules.

(a) Foul Shots.

The following are examples of foul shots.

(1) Touching any ball with body or clothing. (2) Picking up any ball not being the ball selected. Playing with balls incorrectly respotted. (3) Playing out of turn. (4) Potting two reds (seven point foul) consecutively. In fact almost all of the foul shots to be seen in the real game of snooker can be incurred in this game.

(b) After the player has made a pot it is the duty of the other player to clear the pocket with the wooden rod 48 provided and to advance his score.

(c) If the cue or any of the balls become marked in such a way as to give an unfair advantage to a player the opposing player may ask that they be cleaned.

(e) If the white ball is accidentally propelled into a pocket it is deemed an "in-off" and the opponent given points the penalty value of the ball "on".

(f) If, after the white ball has been picked up correctly, a red or nominated colour is repelled away and into a pocket, it is a fluke and the ball must be respotted or returned to the tray. The players score is advanced by the correct number of points and the break continues. It is not permitted to make this happen deliberately.

(g) To improve the general feel of the game still further, when balls are "randomly" returned to the table, they should be placed roughly in the positions they may have finished in if it were a real game on a real table. This is not however, a hard and fast rule because it would clearly cause endless debate. It is optional.

8. Shown below are the scoring and penalty values of each ball.

| Colour | Points Value | Penalty Value |
|---|---|---|
| White | — | 4 pts. |
| Red | 1 | 4 pts. |
| Yellow | 2 | 4 pts. |
| Green | 3 | 4 pts. |
| Brown | 4 | 4 pts. |
| Blue | 5 | 5 pts. |
| Pink | 6 | 6 pts. |
| Black | 7 | 7 pts. |

In a modification the safety shot option may be omitted and instead a referee flipper provided under a hole labelled "referee" to give a "YES" option or a "NO" option. Where any dispute between the players arises the referee flipper is used to settle the dispute by submitting a question in a form to which a simple "YES" or "NO" answer is required and inserting the cue into the hole marked "referee" to produce a "YES" or "NO" answer. The referee flipper can be used to start the game by asking the referee to decide the toss of a coin.

In a modification the board and balls may be adapted to play other related games such a 8 ball pool in which case the rules of 8 ball pool will apply in place of the snooker rules.

I claim:

1. Random selection apparatus comprising a container defining a chamber having a tapering throat, a magnetic member housed within the chamber having at least one pair of axially opposite differently designed faces magnetically polarized as north and south poles, respectively, the taper of the throat being such as to hold the magnetic member captive within the container, an elongate member magnetically polarized by north and south poles at opposite ends and having a cross-section sufficiently small to enter the chamber through the throat, a floor of the chamber being so profiled that when the magnetic member lies on the floor, an upper face of the member does not extend parallel to a mouth of the throat, whereby, when a randomly selected end of the elongate member is inserted into the chamber and then withdrawn, the elongate member will coact with the magnetic member and draw the magnetic member into the throat for lodgement therein so that a randomly selected face of the magnetic member becomes exposed to view.

2. Apparatus according to claim 1 wherein sides of the magnetic member adjacent opposite faces are tapered so as to have a complementary taper to the throat, whereby the upper face of the member, when drawn into the throat, is flush with the mouth of the throat.

3. Apparatus according to claim 1 including magnetisable means provided adjacent the throat to co-operate with the magnetic member when drawn up into the throat to hold the member in the throat until subsequently dislodged by the elongate member or another member.

4. Apparatus according to claim 1 wherein the magnetic member or a part of the container defining the throat is of compressible or flexible material to allow the magnetic member to become temporarily wedged in the throat when drawn up into the throat.

5. Apparatus according to claim 1 wherein the profile of the floor of the container is such that it defines a central hump directly below the mouth of the throat.

6. Apparatus according to claim 1 wherein the axially opposite faces of the magnetic member are different colors.

7. Random selection apparatus comprising:

a container defining a chamber having an open mouth and a floor;

a magnetic member held captive in said chamber, said magnetic member having different surfaces carrying different legends and being magnetically polarized along a first predetermined axis to present north and south poles, respectively;

an elongate member having at least a portion magnetically polarized along a second predetermined axis, the second predetermined axis being inclined such that, upon insertion into the chamber, the second predetermined axis is always inclined to the first predetermined axis when said magnetic member lies on the floor of said chamber to thereby ensure that the magnetic member is attracted to the elongate member; and means for maintaining said magnetic member in said mouth when drawn thereto by said elongate member.

8. Apparatus according to claim 7 wherein said first predetermined axis intersects the different surfaces carrying the different legends.

9. Apparatus according to claim 8 wherein the angle at which said first predetermined axis intersects the different surfaces is 90°.

10. Apparatus according to claim 9 wherein said second predetermined axis extends at right angles to the longitudinal axis of the elongate member.

11. Apparatus according to claim 10 including guide means for aligning said magnetic member with said mouth when drawn up to said mouth in response to extraction of said elongate member.

12. Apparatus according to claim 11 wherein said guide means comprises a throat or necked portion of said container.

13. Apparatus according to claim 11 wherein said guide means comprises a plurality of ribs extending radially inwardly from the inner surface of the container to define a channel from the mouth to the interior of the chamber, the channel widening with longitudinal distance from the mouth.

* * * * *